US006446265B1

(12) United States Patent
Moreau et al.

(10) Patent No.: US 6,446,265 B1
(45) Date of Patent: Sep. 10, 2002

(54) HAT TETHER APPARATUS AND METHOD

(76) Inventors: Darrell A. Moreau, 6 Pleasant St., F7, Hooksett, NH (US) 03106; Andre W. Moreau, 6 Pleasant St., E12, Hooksett, NH (US) 03106

( * ) Notice: Subject to any disclaimer, the term of this patent is extended or adjusted under 35 U.S.C. 154(b) by 0 days.

(21) Appl. No.: 09/870,109

(22) Filed: May 30, 2001

(51) Int. Cl.[7] ..... A42B 7/00
(52) U.S. Cl. ..... 2/175.7
(58) Field of Search ..... 2/175.7, 417, 418, 2/171, 421, 422

(56) References Cited

U.S. PATENT DOCUMENTS

| | | | | | |
|---|---|---|---|---|---|
| 701,639 | A | * | 6/1902 | Stamm | 2/175.7 |
| 903,037 | A | * | 11/1908 | Westlund | 2/175.7 |
| 938,281 | A | * | 10/1909 | Shaw | 2/175.7 |
| 1,055,676 | A | * | 3/1913 | Soneshein | 2/175.7 |
| 2,686,917 | A | * | 8/1954 | Auerbach | 2/172 |
| 4,263,679 | A | | 4/1981 | Erlendson | |
| 4,276,657 | A | | 7/1981 | Montesi | |
| D293,043 | S | | 12/1987 | Zamboni | |
| 4,991,236 | A | | 2/1991 | Pritchett | |
| 4,993,079 | A | | 2/1991 | Johnson | |
| 5,092,472 | A | | 3/1992 | Jones | |
| 5,144,695 | A | | 9/1992 | Schweizer | |
| 5,514,016 | A | * | 5/1996 | Larson | 441/6 |
| D371,006 | S | | 6/1996 | Walker et al. | |
| 5,541,816 | A | | 7/1996 | Miserendino | |
| 5,611,118 | A | | 3/1997 | Bibbee | |
| 5,890,638 | A | | 4/1999 | Woloshen | |
| D412,611 | S | | 8/1999 | Simpson | |
| 6,079,419 | A | | 6/2000 | Perlsweig | |
| 6,154,887 | A | * | 12/2000 | Yagi | 2/175.7 |

FOREIGN PATENT DOCUMENTS

| | | |
|---|---|---|
| JP | 09188914 | 7/1997 |
| JP | 10310928 | 11/1998 |

* cited by examiner

*Primary Examiner*—Gloria M. Hale
*Assistant Examiner*—Tejash Patel
(74) *Attorney, Agent, or Firm*—Robert R. Deleault, Esq.; Mesmer & Deleault, PLLC

(57) ABSTRACT

A hat retaining mechanism has a flexible tether, a clip mechanism attached to one end of the flexible tether to be located on the outside of a hat, and a slidable retraction component on the flexible tether located on the inside of the hat between the other end of the flexible tether that is secured to the inside of the hat and an opening in the hat through which the flexible tether passes.

18 Claims, 4 Drawing Sheets

HAT TETHER APPARATUS AND METHOD

BACKGROUND OF THE INVENTION

1. Field of the Invention

The present invention relates generally to devices for retaining hats. Particularly, the present invention relates to a device to be used in retaining a hat close to a wearer's body. More particularly, the present invention relates to a device for retaining a hat close to a wearer's body that prevents a hat from being blown off or otherwise being removed unintentionally from the wearer's head.

2. Description of the Prior Art

Visored caps, especially baseball hats, are currently very popular. One difficulty experienced by people wearing visored caps is that the cap can be unexpectedly lifted from a person's head under windy conditions. This problem is particularly bothersome when traveling in an open-air vehicle such as a convertible automobile, motorcycle, Jet Ski, speedboat, or amusement park ride at relatively high speeds.

Numerous devices have been proposed in the art for preventing a hat worn by a person from blowing off completely free of the wearer, requiring the wearer to retrieve the hat in a distant location. U.S. Pat. No. 4,991,236 (1991, Pritchett) discloses a hat retaining device having a first head loop and a hat holding member for connecting a hat to be worn to the first head loop. The first head loop is of a size sufficient to be slipped over a wearer's head. The hat holding member is adapted to attach to the hat and permit the head loop to rest loosely around the wearer's neck.

U.S. Pat. No. 5,611,118 (1997, Bibbee) discloses a device for retaining a visored cap upon a wearer's head. The device includes a strap member and a pair of clamp members that directly engage the strap member and a portion of a visor on a cap. The retaining device also includes an adjustment member that allows a wearer to vary the effective length of the strap member. Each of the clamp members and the adjustment member includes a housing having a cavity and an opening formed therein, a pin member slidable in the cavity with an opening formed therein, and a spring to bias the pin member.

U.S. Pat. No. 5,144,695 (1992, Schweizer) discloses a retaining device having a pair of tether members operatively connected together by a slide member. One end of the tether members are provided with clip elements having spring loaded jaws that captively, yet releasably, engage selective portions of the headwear.

U.S. Pat. No. 4,993,079 (1991, Johnson) discloses a hat retaining device that is a headband for securing around a wearer's head. The headband has loop fiber pieces that attach to matching cut loop pieces in the inner band of a hat.

A major disadvantage of the prior art devices is that, when wind conditions are such that a tether is not needed, the prior art devices are not easily stored without their complete removal from the hat.

Therefore, what is needed is a hat retaining device that can be used on any hat, visored or nonvisored. What is further needed is a hat retaining device that can be inconspicuously stored when the device is not needed.

SUMMARY OF THE INVENTION

It is an object of the present invention to provide a hat retaining device that can be used on both a visored and an unvisored hat. It is another object of the present invention to provide a hat retaining device that has a tether that can be retracted into the inner band of the hat when the device is not in use. It is still another object of the present invention to provide a retaining mechanism that attaches to the clothing of a wearer, can be inconspicuously stored when not in use, does not limit the wearer's head movement, and is comfortable to use.

The present invention achieves these and other objectives by providing a hat retaining apparatus that includes an elongated, retractable tether having a first end and a second end and a holding/clip mechanism attached to the second end. The first end of the elongated retractable tether is either attached to the inside of the hat proximate to the adjustable band of the hat or has an enlarged end sized such that the first end of the retractable tether is unable to pass through an opening in the hat next described. The retractable tether passes through an opening through the hat material proximate to the hat band, through the adjustable band of the hat, or at the junction between the inner band and the adjustable band of the hat. The retractable tether may optionally include a slidable, ring-like structure disposed on the retractable tether between the first end, which is preferably secured to the inside of the hat, and the opening through the hat material. The slidable, ring-like structure allows a wearer to easily retract the retractable tether within the inside of the inner band of the hat for easy storage of the retractable tether when not in use. The retractable tether may also be stored along the apex of the hat which goes from the forehead of the wearer, passing over the crown down to the back of the hat by way of a thin sleeve. When the retractable tether is in the stored position, the holding mechanism of the hat retaining apparatus is easily stored by attaching the holding mechanism to a portion of the adjustable band or the hat.

The retractable tether may be a flexible cord or ribbon having sufficient tensile strength to hold the hat in the event the hat is unexpectedly blown or knocked off of the wearer's head. The holding mechanism may be configured to have a low profile and to have an inconspicuous color allowing the holding mechanism to blend in and be less noticeable. On the other hand, the hat retaining apparatus may have contrasting colors or bright colors to match the current fashion trends.

A hat retaining apparatus kit is also provided with instructions for fastening the present invention to existing hats. The kit includes an elongated tether, a holding mechanism for removable attachment or for permanent attachment to the tether, a retraction component for slidable engagement with the elongated tether, and an optional securing mechanism for securing one end of the elongated tether to the inner band of the hat. Instructions and a grommet for creating and/or securing the above-mentioned opening are also optionally provided for attaching the hat retaining apparatus to the hat.

DETAILED DESCRIPTION OF THE PREFERRED EMBODIMENT

Figure 1:
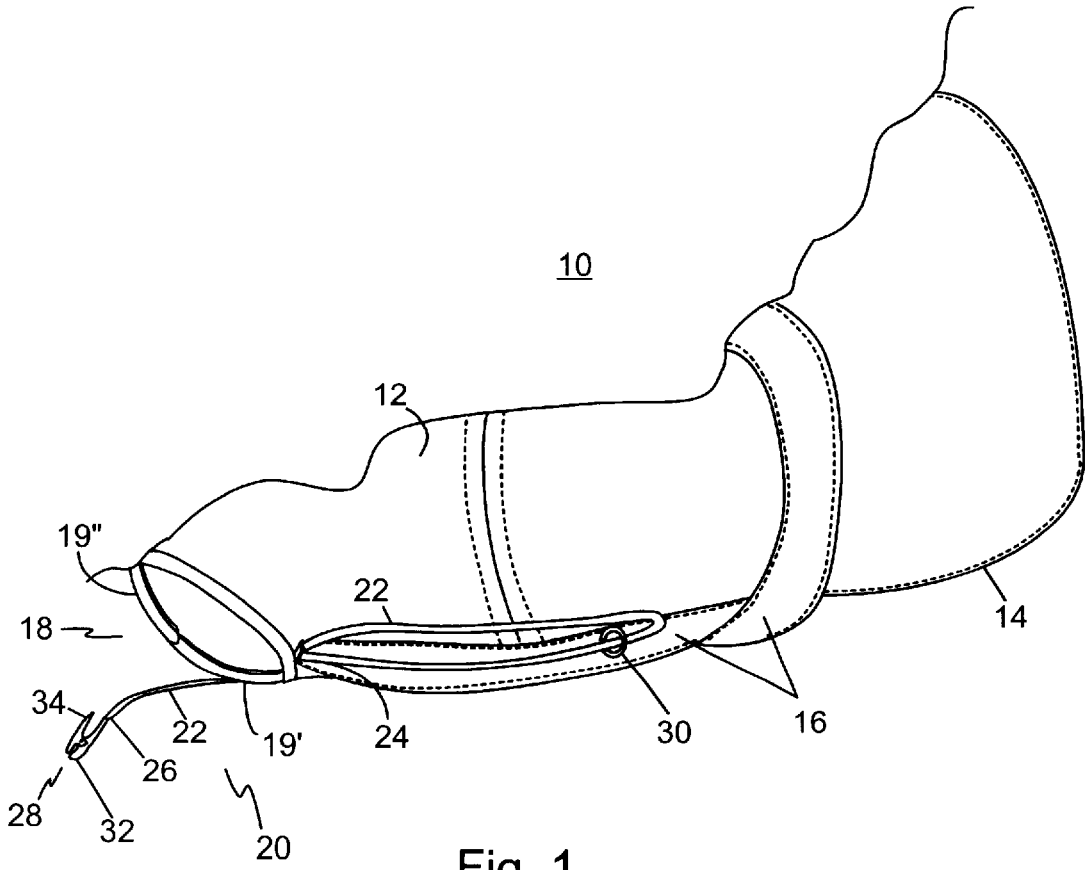
FIG. 1 is a partial perspective view showing the inside band of the hat with the hat tether member and tether pull ring.

The preferred embodiments of the present invention are illustrated in FIGS. 1–7. FIG. 1 shows a partial perspective view of the inside of a hat 10 with a hat retaining system 20. Hat 10 includes a cap portion 12, a visor 14, a hat band 16, and an adjustable hat band portion 18. Typically, hat band 16 is fastened to cap portion 12 only on one peripheral edge, thus creating an accessible space between hat band 16 and cap portion 12. Adjustable hat band portion 18 has a relatively narrow band extending around at least a portion of the back of a wearer's head which is exposed, or not covered by, cap portion 12. Adjustable hat band portion 18 generally includes a first tongue member 19' and a second tongue member 19" that cooperate with each other to adjust the size of the hat to fit a particular wearer's head.

A portion of hat band 16 is inverted to show the space between hat band 16 and cap portion 12 on the inside of hat 10. Hat retaining system 20 includes a hat retaining tether 22 having a first tether end 24 and a second tether end 26, a clip mechanism 28 attached to the second tether end 26, and a tether retraction device 30. Hat retaining tether 22 passes through an opening (not shown) from the inside of hat 10 to the outside. First tether end 24 is preferably secured to hat 10. An alternative to securing first tether end 24 to hat 10 is to enlarge first tether end 10 such that first tether end 24 cannot pass through the opening through which hat retaining tether 22 passes. First tether end 24 may be enlarged by forming a knot in the tether at first tether end 24, or a larger diameter component may be attached to first tether end 24. It is to be recognized that the present invention is not limited to use with a particular style of hat or visor unless otherwise indicated, and, in fact, may be used with unvisored hats as well. A representative adjustable band 18, typical of the adjustable band found on adjustable baseball-style hats, is shown in FIGS. 1, 2 and 3.

Hat retaining tether 22 is made up of a predetermined length of tether material. The tether material may be made of natural or synthetic material in the shape of a cord having a circular or oval diameter, or in the shape of a material strip. Some measure of cord elasticity may be provided in varying widths and diameters. Other elastic-type cords will also provide the generally desirable elastic features which are intended to reduce the amount of "jerk" that the wearer feels when the hat 10 is abruptly removed from the head. A braided nylon cord having a diameter on the order of one-sixteenth to one-eighth of an inch will also generally have sufficient strength to yield the desired performance, although thicker or thinner diameters of nylon cord could be employed as well. Other tether material includes neoprene, cloth fabric sewn into tubular form, synthetic fiber knit into a tubular shape, or any other elastic or non-elastic tubing or cord-type material.

As depicted, clip mechanism 28 comprises a clip having spring-biased clamping jaws 32 that can be separated by squeezing handles 34 together to receive the upper-body clothing material therebetween. The spring bias returns the jaws 34 toward each other to grasp and retain the clothing material. The clip mechanism 28 preferably has an integral second securing mechanism at one of the handles 34 for securing the clip mechanism 28 to second tether end 26. It is to be noted that clip mechanism 28 may comprise any of a number of paired clamping jaws, other examples being a suspender-type clip or an alligator-type clip, as desired. The principal criteria for selecting an appropriate clip mechanism 28 would be cost and ease of manufacture and, ultimately, ease of use.

Figure 2:
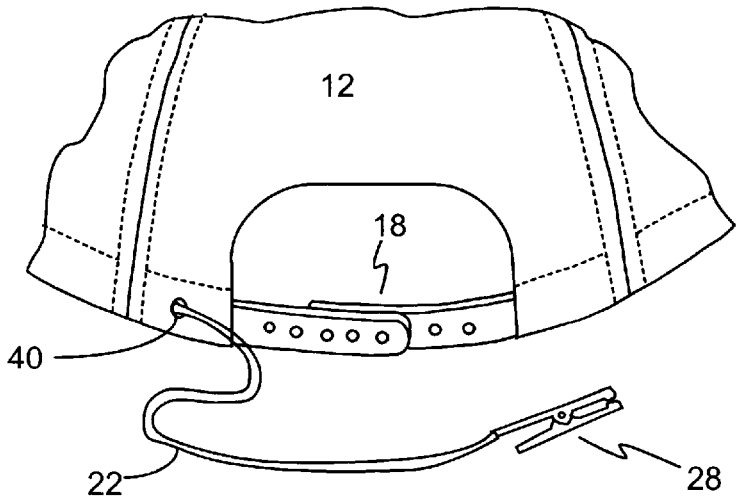
FIG. 2 is a partial perspective view showing the hat tether member of the present invention combined with the back of the hat, the tether member passing through an egress in the hat.
Figure 3:
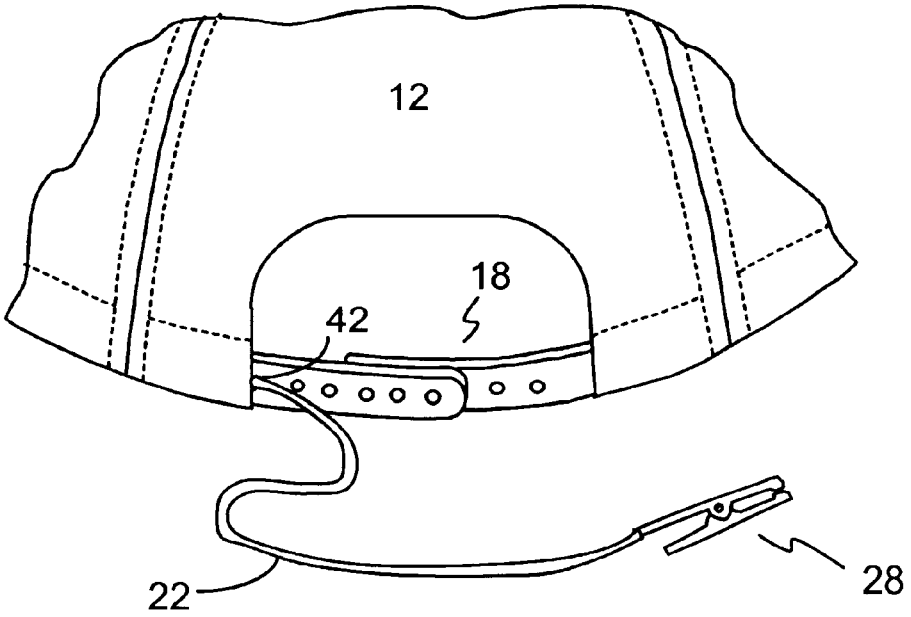
FIG. 3 is a partial perspective view showing the hat tether member of the present invention combined with the back of the hat, the tether member passing through an opening in the seam between the hat band and the hat adjusting band member.

Turning now to FIG. 2, the back of hat 10 is shown in a partial perspective view of the cap portion 12, the adjustable hat band portion 18, an opening 40 in cap portion 12 proximate to hat band 16 and adjustable hat band portion 18, and tether 22 passing through opening 40. Opening 40 is sized to allow tether 22 to freely slide in and out of the inside of cap portion 12 to a predetermined length depending on the distance between the rear of hat 12 positioned on a wearer's head and the upper-body clothing to which clip mechanism 28 attaches.

Figure 4:
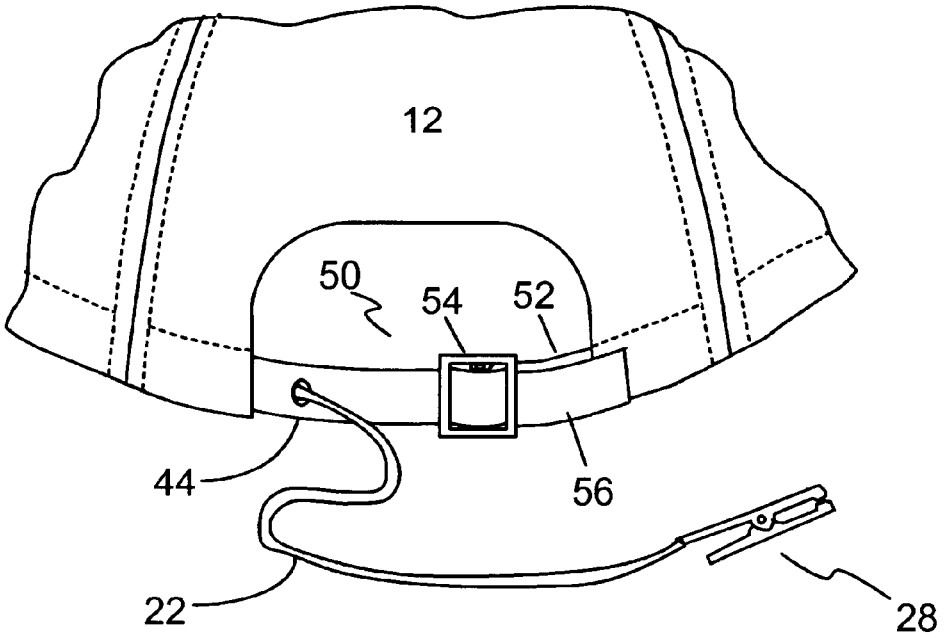
FIG. 4 is a partial perspective view showing the hat tether member of the present invention combined with the back of the hat, the tether member passing through an egress in the hat adjusting band member.

FIG. 3 illustrates another position and embodiment for opening 40. In this embodiment, the junction between adjustable band 18 and top hat portion 12 is adapted to allow hat tether 22 to freely slide in and out of opening 42 where hat band 16 and adjustable band 18 meet. FIG. 4 illustrates an alternative adjustable hat band 50 that includes a first band 52 with a buckle-shaped device 54 forming one end of first band 52 and a second end of band 52 being securely fastened to cap portion 12 at hat band 16. A second band 56 is made to pass through buckle-shaped device 54 for adjusting the size of hat 10. Second band 56 preferably has an opening 44 that allows hat tether 22 to freely slide in and out of opening 44. Although first and second bands 52 and 56, respectively, may be a flat strip of fabric, it is preferable that second band 56 be made of a cloth fabric sewn into tubular form. This allows hat tether 22 to pass through opening 44 into the inside of the tubular fabric and through the junction of hat band 16 and second band 52 into the space defined between hat band 16 and cap portion 12. This configuration provides comfort to the wearer whereby the wearer does not feel the hat tether 22 or the retracting ring 30 when hat 12 is worn.

Figure 5:
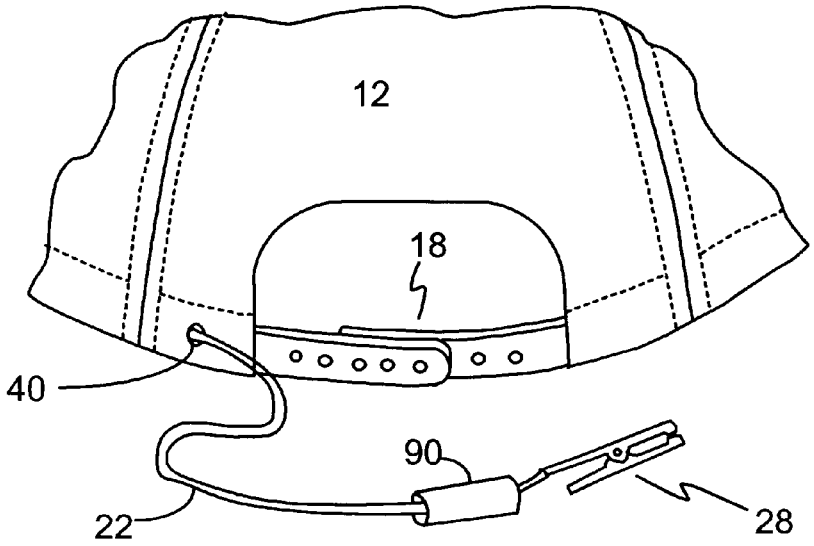
FIG. 5 is a partial perspective view of another embodiment of the present invention showing the hat tether member of the present invention combined with a floatation device around the hat tether member.

FIG. 5 shows an optional feature that may be provided on hat retainer system 20 especially where the hat and device are worn near the water or on boats. A floatation component 90 in the form of a bobber may be provided along the length of hat tether 22. Floatation component 90 will aid in maintaining the hat and hat retaining system 20 near the surface of the water in the event that the hat is inadvertently dropped or knocked into the water and becomes water logged and begins to sink before the owner/wearer has an opportunity to reclaim the hat.

Figure 6:
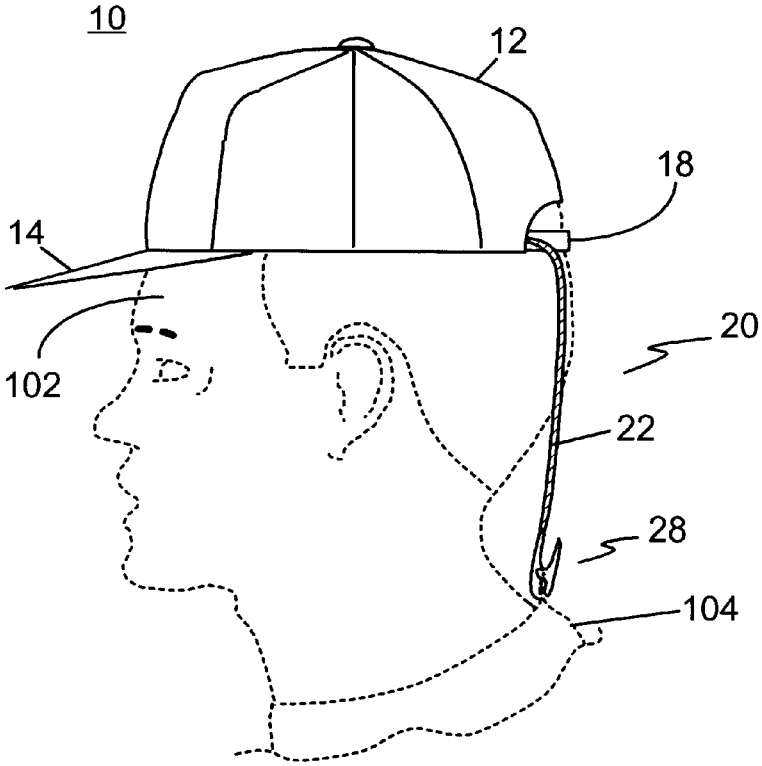
FIG. 6 is a side view of a head of a hat wearer showing a hat worn on the head and the hat tether member of the present invention as typically worn by the hat wearer.

FIG. 6 depicts hat 10 and hat retaining system 20 as worn by a person. The hat 10 is shown on a wearer's head 102 with the clip mechanism 28 secured to the wearer's shirt 104. Hat 10, as shown, includes a visor 14, a cap portion 12 and an adjustable hat band 18. Even though FIG. 6 illustrates the clip mechanism 28 being secured to the collar portion of the wearer's shirt, it is understood that clip mechanism 28 may be attached to any part of the upper-body clothing of the wearer that is within reach of the clip mechanism 28. The hat retaining system 20 includes hat tether 22, which is made up of a predetermined length of cord material. Hat tether 22 is preferably fixedly attached to the inside of hat 10, though, as discussed previously, may simply have an enlarged first tether end that prevents first tether end from being pulled through the opening through which the hat tether 22 passes to the outside of hat 10.

Figure 7:
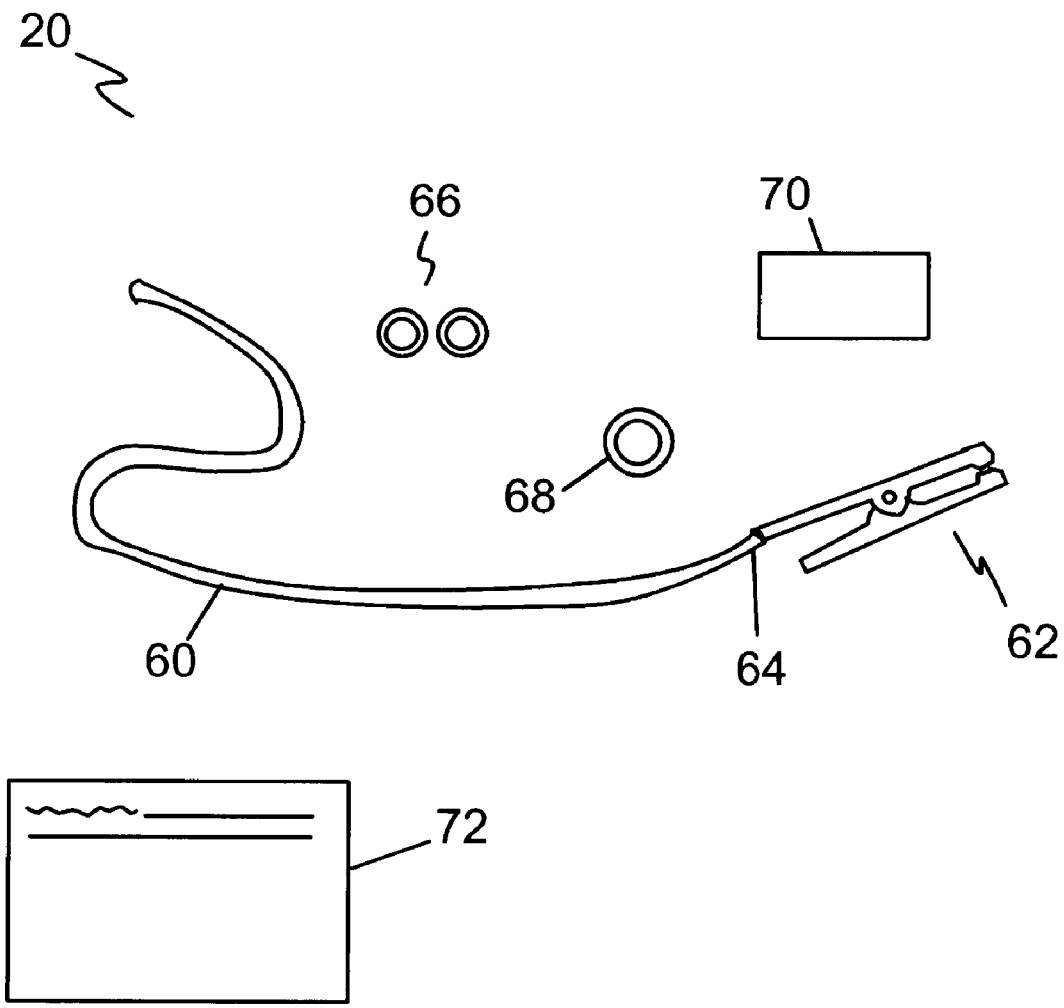
FIG. 7 is a plan view showing the components of a kit of the present invention.

Hat retaining system 20 may be provided as a kit for attachment to an existing hat, or it can be supplied as a component of a headwear system where a particular hat and hat retaining system are supplied as a unit. For example, if hat retaining system 20 is supplied as a kit as illustrated in FIG. 7, the kit may contain a tether 60 with a clip mechanism 62 attached to a first tether end 64, a two-piece, miniature, snap grommet 66, a retraction ring 68, an optional adhesive strip 70 for fastening a second tether end 65 to the inside of a hat band, and optional instructions 72. Adhesive strip 70 may incorporate a pressure-adhesive, a heat-activated adhesive, or an air or chemical activated adhesive. It should be understood that second tether end 65 may also be sewn to the hat band instead of using an adhesive strip or other fastening mechanism. Where a snap grommet 66 is used, the grommet 66 would be positioned in an unobtrusive location on hat 10 such as that shown in FIG. 2 or on second tubular band 56 such as that shown in FIG. 4. Snap grommet 66 is assembled in such a way that the two-piece grommet 66 would captivate the hat material between the two pieces when the grommet 66 is snapped together. The captive hat material in the center of grommet 66 is then cut away, unless grommet 66 is of the type that cuts the hole in the material as it is snapped together. Second tether end 65 is threaded through grommet 66 to the inside of the hat. Retraction ring 68 is then placed/slid over second tether end 65 and second tether end 65 is then secured to the inside of the hat band by sewing or using an optional fastening mechanism such as the adhesive material previously described.

When not in use, hat tether 22 may be retracted within the inside of hat band 16 by grasping the retraction ring 30, as shown in FIG. 1, and pulling ring 30. This causes hat tether 22 to be drawn through opening 40 into the inside of hat band 16. Clip mechanism 28 may then be stored by attaching the jaws 32 to the extension of tongue component 19' or to cap portion 12. When needed, the user may then grasp clip mechanism 28 of hat retaining system 20 and pull a predetermined amount of tether 22 sufficient to allow the user to attach the clip mechanism to the user's upper-body clothing, preferably behind the user.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A hat retaining apparatus for a headgear having a cap portion and a headband, said hat retaining apparatus comprising:

a flexible tether member having a first end and a second end, said first end being located between said cap portion and said headband;

a clip mechanism attached to said second end of said flexible tether wherein said second end is located on an outside of said headgear, said clip mechanism configured for releasable attachment to a user's clothing; and a retraction component slidably disposed on a portion of said flexible tether between said first end and said second end and lying within an inside of said headgear wherein said portion of said flexible tether slides through said retraction component when a user pulls said retraction component.

2. The apparatus of claim 1 wherein said flexible tether member is shaped as a cord or a ribbon.

3. The apparatus of claim 1 wherein said slidable retraction component has a ring-like shape.

4. A headgear system comprising:

a hat adapted to be worn on a head of a wearer, said hat having a cap portion and an inner hat band; and a hat retaining apparatus, said hat retaining apparatus comprising:

a flexible tether member having a first end and a second end, said first end being configured for secure retention within an inside of said hat between said cap portion and said inner hat band, said flexible tether member passing through an aperture to said second end at a location proximate to the back of said hat; and a clip mechanism attached to said second end of said flexible tether member.

5. The headwear system of claim 4 further comprising a retraction component slidably disposed on a portion of said flexible tether member between said first end and said aperture wherein said portion of said flexible tether slides through said retraction component when a user pulls said retraction component.

6. The headwear system of claim 5 wherein said retraction component has a ring-like shape.

7. The headwear system of claim 4 wherein said clip mechanism is structured for releasable attachment to clothing about the back of a wearer.

8. The headwear system of claim 4 wherein said flexible tether member is cord-shaped or ribbon-shaped.

9. The headwear system of claim 4 wherein said aperture is located in a position selected from the group consisting of said cap portion and an adjustable band.

10. A method of making a hat retaining headwear system comprising:

obtaining a length of flexible tether material;

forming an aperture in said hat proximate to the rear of said hat, said aperture providing an egress from an inside of said hat to an outside of said hat for said flexible tether material;

configuring a first end of said flexible tether material for retention within said inside of said hat between a cap portion and a headband through said aperture;

passing a second end of said flexible tether material through said aperture; and attaching a clip mechanism to said second end of said flexible tether material.

11. The method of claim 10 further comprising passing said second end of said flexible tether material through a tether retraction component before passing said second end through said aperture.

12. The method of claim 10 wherein said step of configuring said first end is selected from the group consisting of sewing said first end to said headband of said hat and enlarging said first end to prevent passage of said first end from said inside of said hat through said aperture to said outside of said hat.

13. A method of storing a hat retaining mechanism of a headwear system, said method comprising:

grasping a slidable retraction mechanism located on a flexible tether between a first end of said flexible tether that is configured for retention within an inside of a hat proximate to the rear of said hat and an aperture located adjacent said first end through which said flexible tether passes to an outside of said hat to a second end having a clip mechanism attached thereto;

pulling said slidable retraction mechanism causing said flexible tether to ingress to said inside of said hat thereby causing said second end of said flexible tether to get spatially closer to said aperture; and placing said slidable retraction mechanism and said flexible tether located on said inside of said hat between said hat and a headband of said hat for storing said flexible tether and said slidable retraction mechanism.

14. A hat retaining kit comprising:

a flexible tether member having a first tether end, a second tether end and a clip mechanism secured to said second tether end, said first tether end being adaptable for insuring retention of said first tether end between a cap portion and a headband of a hat;

a grommet component adapted to be attached to said hat and having an opening sized to allow said flexible tether member to slide through said opening; and instructions for attaching said flexible tether member and said grommet component to said hat and for storing a major portion of said flexible tether member between said cap portion and said headband when said flexible tether member is in a stored position.

15. The kit of claim 14 further comprising a retraction component adapted to be slidably positioned on said flexible tether member between said first tether end and said grommet component when said kit is attached to said hat.

16. The kit of claim 15 wherein said retraction component has a ring-like shape.

17. The kit of claim 14 wherein said instructions indicate that said grommet component is located in a position selected from the group consisting of said cap portion of said hat, an adjustable band of said hat and said headband of said hat.

18. The kit of claim 14 further comprising a floatation component adapted to be positioned on said flexible tether member between said clip mechanism and an outside of said hat.

* * * * *